US007511670B2

(12) United States Patent
Rao et al.

(10) Patent No.: US 7,511,670 B2
(45) Date of Patent: Mar. 31, 2009

(54) DUAL-POLARIZED, MULTIPLE STRIP-LOOP ANTENNA, AND ASSOCIATED METHODOLOGY, FOR RADIO DEVICE

(75) Inventors: Qinjiang Rao, Waterloo (CA); Geyi Wen, Waterloo (CA); Mark Pecen, Waterloo (CA)

(73) Assignee: Research In Motion Limited, Waterloo (CA)

( * ) Notice: Subject to any disclaimer, the term of this patent is extended or adjusted under 35 U.S.C. 154(b) by 87 days.

(21) Appl. No.: 11/735,589

(22) Filed: Apr. 16, 2007

(65) Prior Publication Data

US 2008/0252550 A1 Oct. 16, 2008

(51) Int. Cl.
*H01Q 1/38* (2006.01)

(52) U.S. Cl. ..... 343/700 MS; 343/702; 343/742; 343/867

(58) Field of Classification Search ..... 343/700 MS, 343/702, 741, 742, 866, 867
See application file for complete search history.

(56) References Cited

U.S. PATENT DOCUMENTS 4,804,965 A * 2/1989 Roederer ..... 343/700 MS
5,646,633 A * 7/1997 Dahlberg ..... 343/700 MS
5,952,971 A * 9/1999 Strickland ..... 343/700 MS
7,394,426 B2 * 7/2008 Ogawa et al. ..... 343/700 MS

FOREIGN PATENT DOCUMENTS

EP 1679763 A2 12/2006

OTHER PUBLICATIONS

A. Adrian; D.H. Schubert, "Dual-Aperture-Coupled Microstrip Antenna for Dual or Circular Polarization," Electronics Letters, vol. 23, Nov. 1987, pp. 1226-1228.
G.S. Parker, A Dual-Polarized Microstrip Ring Antenna with Very Good Isolation, M.E. Thesis, Department of Electrical Engineering, Royal Military College of Canada, Kingston, Canada, 1997.
S. Gao; L. W. Li; T. S. Yeo; M. S. Leong, A Broad-Band Dual-Polarized Microstrip Patch Antenna with Aperture Coupling, IEEE Trans. Antennas and Propagation, vol. 51, No. 4, Apr. 2003, pp. 898-900.
"Mesh Antennas for Dual Polarization", H. Nakano, N. Suzuki, T. Ishii, and , J. Yamauchi, IEEE Transactions on Antennas and Propagation, vol. 49, No. 5, May 2001.

* cited by examiner

*Primary Examiner*—Hoang V Nguyen

(57) ABSTRACT

A dual-polarized antenna, and an associated methodology, is provided for a radio device, such as a mobile station. The antenna is formed of a plurality of loop strips disposed upon a substrate. The loop strips are configured into a pair of L-cornered loops, with the loops sharing a shared set of loop strips. A loop strip of the shared set provides a single feed connection, positioned to permit symmetrical excitation of the antenna.

17 Claims, 8 Drawing Sheets

DUAL-POLARIZED, MULTIPLE STRIP-LOOP ANTENNA, AND ASSOCIATED METHODOLOGY, FOR RADIO DEVICE

The present invention relates generally to an antenna for a portable radio device, such as a Bluetooth-capable or IEEE 802.11-capable device that operates at the IMS (Industry, Medical and Scientific) frequency band. More particularly, the present invention relates to a dual-polarized antenna, and an associated methodology, of compact construction, capable of positioning at, or within, a radio housing of the portable radio device.

L-cornered antenna loops, formed of loop strips, are disposed upon a substrate. The loop strips extend in either of a first polarization direction or a second polarization direction, the second polarization direction orthogonal to the first polarization direction. The loop strips are of dimensions and are connected together to be resonant at the IMS, or other selected, frequency band at orthogonal polarization directions.

BACKGROUND OF THE INVENTION

Radio communication systems are used by many in modern society to communicate. Many varied communication services, both voice communication services and data communication services, are regularly effectuated by way of radio communication systems. And, as technological advancements permit, the types of communication services effectuable by way of radio communication systems shall likely increase.

Cellular communication systems are exemplary of radio communication systems that have high levels of usage. Cellular communication systems are typically constructed to provide wide-area coverage. And, their infrastructures have been installed over significant portions of the populated areas of the world. A user communicates by way of a radio communication system through use of a wireless device, a radio transceiver, sometimes referred to as a mobile station or user equipment (UE). Typically, access to a cellular communication system is provided pursuant to purchase of a subscription, either on a revolving, e.g., monthly basis, or on a prepaid, time-usage basis. Cellular communication systems, operable pursuant to different operating standards, define radio air interfaces at different frequency bands, for instance, at the 800 MHz frequency band, at the 900 MHz frequency band, and at bands located between 1.7 GHz and 2.2 GHz.

Other types of radio communication systems are also widely used, for instance, Bluetooth™-based and IEEE 802.11-based systems, implemented, e.g., as, WLAN (Wireless Local Area Network) systems, also provide for voice and data communications, generally over smaller coverage areas than their cellular counterparts. WLANs are regularly operated as private networks, providing users who have access to such networks the capability to communicate therethrough through the use of Bluetooth-capable or 802.11-capable wireless devices. WLANs are sometimes configured to be connected to public networks, such as the Internet, and, in turn, to other communication networks, such as PSTNs (Public Switched Telephonic Networks) and PLMNs (Public Land Mobile Networks). Interworking entities also are sometimes provided to provide more-direct connection between the small-area networks and a PLMN. Various of the aforementioned systems are implemented at the 2.4 GHZ frequency band.

Radio communication systems are generally bandwidth-constrained. That is to say, bandwidth allocations for their operation are limited. And, such limited allocation of bandwidth, imposes limits upon the communication capacity of the communication system. Significant efforts have been made, and attention directed towards manners by which, to efficiently utilize the limited bandwidth allocated in bandwidth-constrained systems. Dual-polarization communication techniques are sometimes utilized. In a dual-polarization technique, data communicated at the same frequency is communicated in separate, polarized planes. Close to a doubling of the communication capacity is possible through the use of dual-polarization techniques. To transduce signal energy pursuant to a dual-polarization scheme, the wireless device is required to utilize a dual-polarized antenna, operable in the separate polarization planes. Use of dual-polarization techniques also are advantageous for the reason that the effects of multi-path transmission and other interference are generally reduced, thereby improving quality of signal transmission and reception.

A dual-polarized antenna is realizable, for instance, by feeding a square patch antenna at two orthogonal edges thereof by way of an edge feed or a probe feed. Generally, existing dual-polarized patch antennas are used in conjunction with two feeding-network circuits. Such existing antennas suffer from various limitations. For instance, separation distances between the feed connections are required to be great enough to prevent occurrence of coupling between the respective feeding lines. Excessive amounts of coupling results in high cross polarization levels.

As wireless devices are of increasingly small dimensions, packaged in housings of increasingly-smaller dimensions, problems associated with the cross-polarization levels are likely to become more significant. An improved, dual-polarized antenna, constructed in a manner to reduce such deleterious problems is needed.

It is in light of this background information related to antennas for radio devices that the significant improvements of the present invention have evolved.

DETAILED DESCRIPTION

Figure 1:
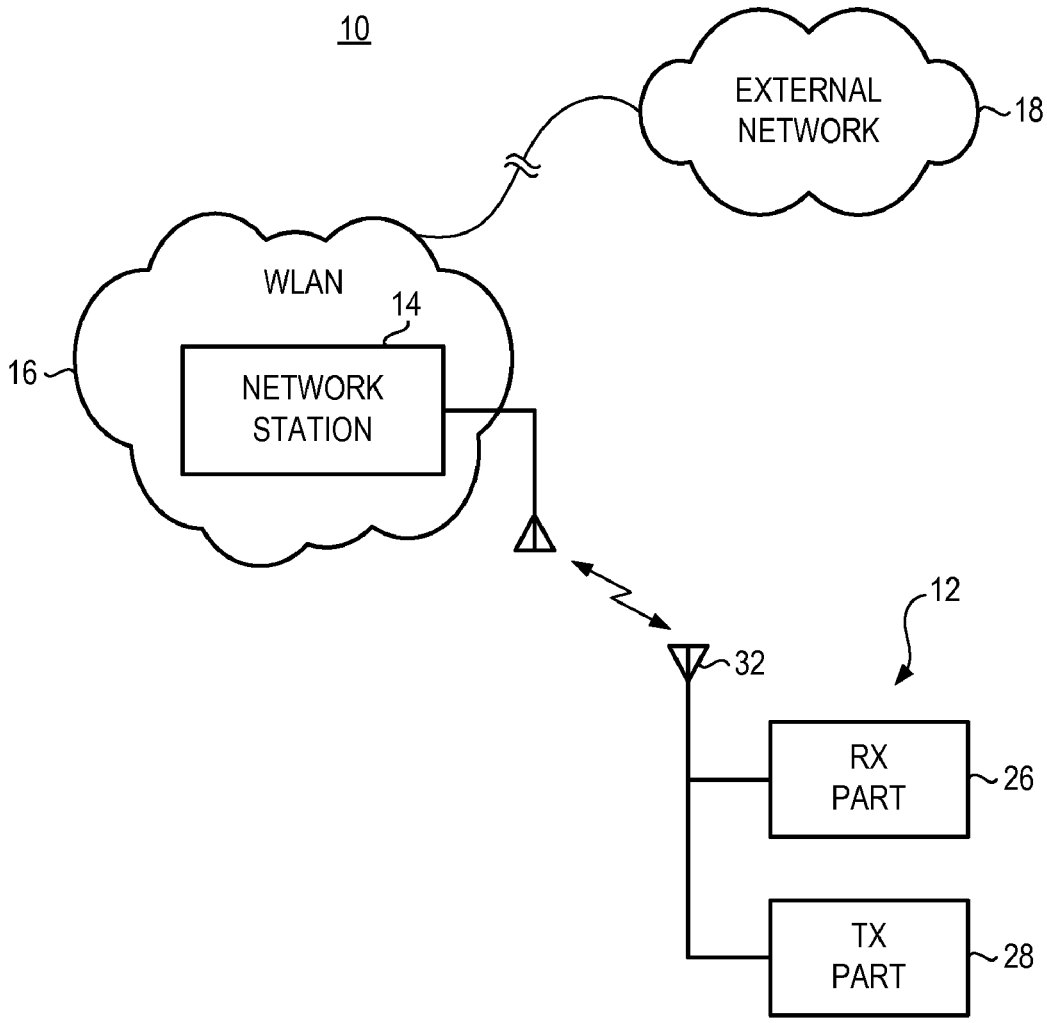
FIG. 1 illustrates a functional block diagram of a radio communication system in which an embodiment of the present invention is operable.

The present invention, accordingly, advantageously provides antenna apparatus, and an associated method, for a portable radio device, such as a Bluetooth-compatible or 802.11-compatible device that operates at the IMS (Industry, Medical and Scientific) frequency band.

Through operation of an embodiment of the present invention, a dual-polarized antenna of compact construction is provided. The antenna is capable of positioning at, or within, a radio housing of the portable radio device.

In one aspect of the present invention, the antenna is formed of loop strips etched upon a substrate, configured in a manner to be resonant at a selected frequency band, such as a frequency band located at 2.47 GHz. The substrate is of dimensions permitting its positioning, together with the loop strips etched thereon, within the housing of a portable radio device, such as a wireless device operable in a Bluetooth-compatible or 802.11-compatible system. Signal energy polarized in orthogonal, or other, directions. Transduced signal energy generated at the wireless device is transduced into electromagnetic form by the antenna and propagated therefrom in the polarized directions. And, electromagnetic energy communicated to the wireless device in the polarized directions is transduced into electrical form for subsequent operations thereon by circuitry of the radio device.

In another aspect of the present invention, a first group of the loop strips etched onto the substrate is configured to form an L-cornered antenna loop. The L-cornered loop is formed by configuring adjacent loop strips such that ends of the adjacent loop strips intersect at substantially perpendicular angles. The loop strips of the first group, so-configured, are all, therefore positioned variously to extend in a first polarization direction or a second polarization direction, the second polarization direction orthogonal to the first polarization direction.

In another aspect of the present invention, a second group of loop strips etched onto the substrate define a second L-cornered loop. Adjacent ones of the loop strips are configured to be connected at their ends at intersecting, substantially-perpendicular angles, thereby to be rectangular-cornered. And, each loop strip, so-configured, extends variously in a first polarization direction or a second polarization direction, orthogonal to a first polarization direction. Signal energy is transduced by the second loop, also in the two polarization directions.

In another aspect of the present invention, the first group and second group of the loop strips include a shared set of loop strips, i.e., loop strips that are common to both the first group and the second group. The shared set of loop strips form part of the first antenna loop and part of the second antenna loop. At least one of the loop strips of the shared set extends in the first polarization direction, and at least one of the loop strips of the shared set extends in the second polarization direction. And, more specifically, the shared set includes at least two loop strips that extend in the first polarization direction and at least one loop strip that extends in the second polarization direction. The loop strips that extend in the first polarization direction are connected together by way of a loop strip that extends in the second polarization direction.

In another aspect of the present invention, a single feed connection is provided for both of the polarization directions. The single feed connection is formed, or otherwise defined, at a loop strip of the shared set. The feed connection is positioned to permit symmetrical excitation of the two antenna loops. Through the use of the single feed connection, problems associated with cross polarization are reduced. A high-gain, high-efficiency, and compact, dual-polarized antenna is thereby provided.

In these and other aspects, therefore, antenna apparatus, and an associated methodology is provided for a radio device. A substrate is provided. And a first group of loop strips is disposed upon the substrate. The loop strips of the first group are configured to form a first loop having at least one loop strip extending in a first polarization direction and at least one loop strip extending in a second polarization direction. A second group of loop strips is disposed upon the substrate. The loop strips of the second group are configured to form a second loop having at least one strip that extends in the first polarization direction and at least one strip extending in the second polarization direction. The first and second groups of loop strips each have loop strips that extend in the first and second polarization directions, respectively, and exhibit dual-polarization operation.

Turning first, therefore, to FIG. 1, a radio communication system, shown generally at 10, provides for communications with a mobile station 12. The mobile station, in the exemplary implementation, operates pursuant to a Bluetooth standard or IEEE 802.11 (b) or (g) standard, operable to send and to receive signals at the 2.4 GHz band. More generally, the mobile station 12 is representative of any of various wireless devices, and the radio communication system is representative of any various radio communication systems operable in conformity with any of various communication standards or permitting of operation at unregulated frequency bands. Accordingly, while the following description shall describe exemplary operation of a Bluetooth or IEEE 802.11-compliant system, operable at the 2.4 GHz frequency band, it should be understood that the following description is merely exemplary and that the description of operation of the radio communication system operable in conformity in another manner is analogous.

The radio communication system includes a network part, here represented by a network station 14. The network station comprises, for instance, an access point of a WLAN or an analogous entity that transceives signals with wireless devices, such as the mobile station 12. The network station, which here forms an access point, is part of a local network structure (WLAN) 16 that, in turn, is coupled to an external network, here a public packet data network (PDN) 18, such as the Internet.

The operating standard pursuant to which the mobile and network stations are operable is permitting of, and here provides for, dual-polarized communications at the operational frequency band of the communication system, here an ISM band that extends between 2.40 and 2.485 GHz.

The mobile station 12 includes transceiver circuitry, here represented by a receive (RX) part 26 and a transmit (TX) part 28. The receive and transmit parts are coupled, such as by way of an antenna coupler or other entity that provides isolation between the transceiver parts to an antenna 32 of an embodiment of the present invention. The transceiver circuitry is capable of dual-polarization operation. That is to say, the transmit and receive parts are capable of generating signals for transmission in both of the polarization directions and also to operate upon signals communicated to the mobile station in both of the polarization directions.

Correspondingly, the antenna 32 forms a dual-polarized antenna, capable of transducing signal energy of both of the polarization directions. That is to say, signal energy is detected by the antenna in both of the dual-polarization directions. And, signal energy generated at the mobile station is transduced into electromagnetic form and radiated in both of the dual polarization directions. In the exemplary implementation, the antenna 32 is disposed upon a generally planar substrate, of dimensions permitting its positioning within a housing of the mobile station.

Figure 2:
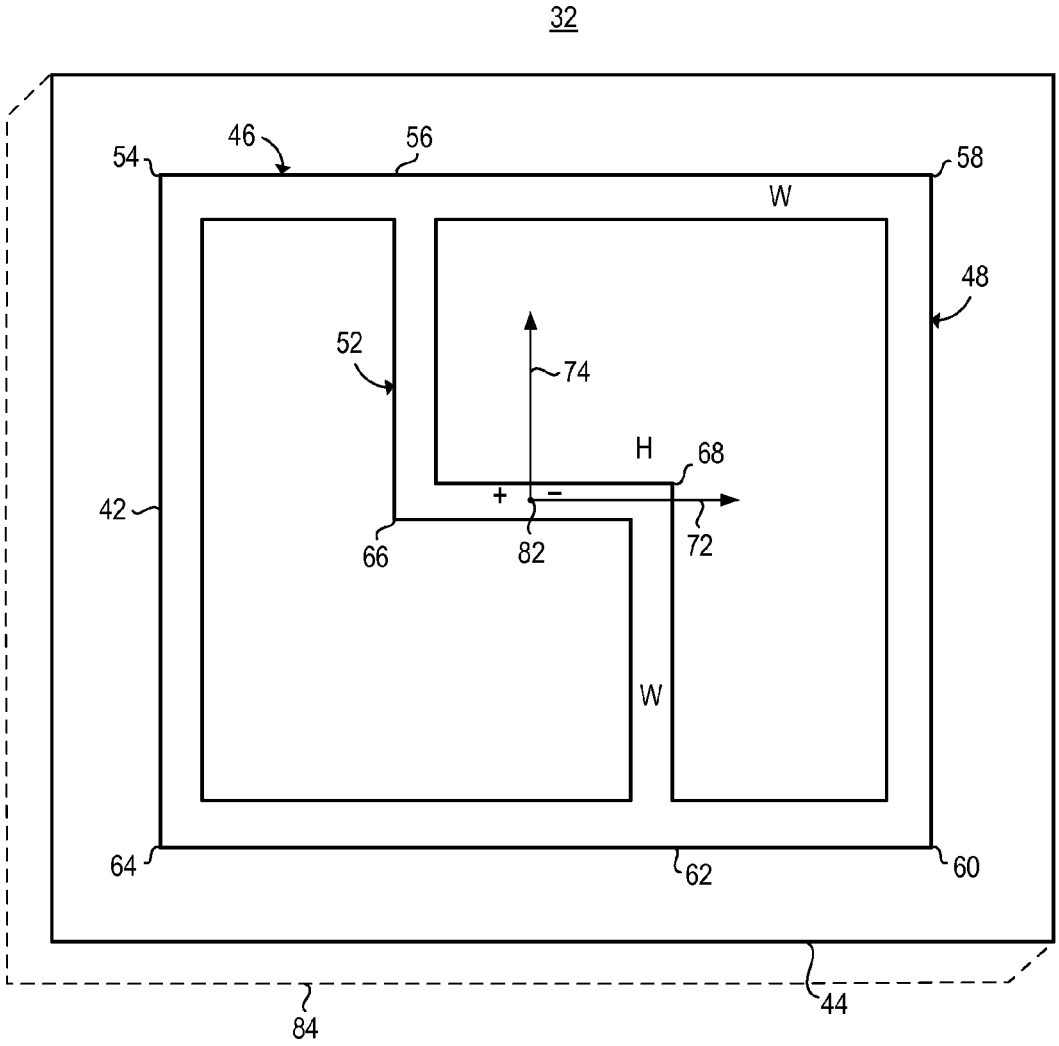
FIG. 2 illustrates a plan view of a dual-polarized, multiple-strip loop antenna of an embodiment of the present invention.

FIG. 2 illustrates in greater detail the antenna 32 of an embodiment of the present invention and that forms part of the mobile station 12, shown in FIG. 1. The antenna is formed of a plurality of loop strips 42 disposed upon a substrate 44. The loops strips are etched, painted, or otherwise formed upon the substrate. The loop strips are configured such that adjacent ones of the loop strips abut against one another in electrical connection therebetween. The loop strips are of lengths and widths and are connected together so as to be resonant at a desired frequency band, here the 2.4 GHz frequency band.

The loop strips are arranged into a rectangular loop structure comprised of a first group 46 of loop strips and a second group 48 of loop strips. The adjacent loop strips intersect at their ends in substantially perpendicular intersecting angles. The groups 46 and 48 form antenna loops-in which, due to the perpendicular intersecting angles of adjacent loop strips, the corners of the loops are L-configured, that is to say, L-cornered.

The loop strips of the loops 46 and 48 include a shared set 52 of loop strips. The loop strips of the shared set are shared between the groups. That is to say, the loop strips of the shared set form parts of both groups 46 and 48.

The shared set, in the exemplary implementation, and as shown, includes three loop strips, connected end-to-end, including two L-cornered portions.

FIG. 2 illustrates references 54, 56, 58, 60, 62, 64, 66, and 68. At each of these reference points, an L-shaped corner of a loop is formed. Due to the substantially perpendicular intersections of the adjacent loop strips, the loop strips each extend in one of two polarization directions. The polarization directions are orthogonal, defined by the axes 72 and 74. The axis 74 defines a first polarization direction, and the axis 72 defines a second polarization direction. Loop strips that extend between reference points 64 and 54, between reference points 60 and 58, between reference points 62 and 68, and between reference points 66 and 56 all extend in the first polarization direction. Loop strips extending between reference points 54 and 56, between reference points 56 and 58, between reference points 64 and 62, between reference points 62 and 60, and between reference points 66 and 68 all extend in the second polarization direction. In the exemplary implementation, and as shown, the lengths defining an outer perimeter of a rectangular configuration defined by the loop strips are all the same. Additionally, loop strips defined by points 54-56, 66-72, and 62-60 are also all of the corresponding lengths. And, in the exemplary implementation, the widths of each of the loop strips is of the same width, w.

The antenna 32 includes a single feed connection 82 providing a feed connection point, connectable to the transceiver circuitry (shown in FIG. 1) of the mobile station (shown in FIG. 1). The single feed connection provides a feed that, positioned as-illustrated at a mid-point of the loop strip 66-68, provides for symmetrical excitation of the loops formed of the groups 46 and 48 of loop strips. Because only a single feed connection is needed, problems associated with spacing requirements required between multiple feed connections, conventionally required, are obviated.

The geometrical configuration of the exemplary implementation of the antenna 32 shown in FIG. 2 provides for three in-phase parallel strips in each of the polarization directions 72 and 74. Strips 54-58, 66-68, and 64-60 extend in the second polarization direction. And, parallel strips 54-64, 58-60, and 56-66/68-62 extending in the first polarization direction permit the antenna to exhibit both high gain and high efficiency.

The two groups 46 and 48 of loop strips are etched on a printed circuit board, or other substrate. The loop strips are regarded as a combination of two electrically-connected, multiple L-shaped, rectangular loop strips that have a common set of shared strips. In a further implementation, the antenna further includes a metal reflector 84 disposed in the strip-loop aperture plane, here disposed beneath a bottom surface of the substrate 44.

Orthogonal, dual-polarization radiation is realized by arranging the loop strips to extend in directions parallel to one of the axes 72 or 74. The feed connection 82, located at the center of the loop strip 66-68, provides for symmetrical excitation, thereby to reduce cross-polarization levels of the dual-polarization components. The loop strips extending in each of the polarization directions are arranged into an in-phase, three-element array that provides high gain levels. The current, i.e., charge flow, direction during operation of the antenna reverses at half-wavelength intervals due to standing wave distributions along the strips. Additionally, each side of the outer-perimetal loop is divided equivalently into three sections, thereby to produce an in-phase current distribution on all of the strip sections if the length of the perimetal loop is appropriately chosen.

Figure 3:
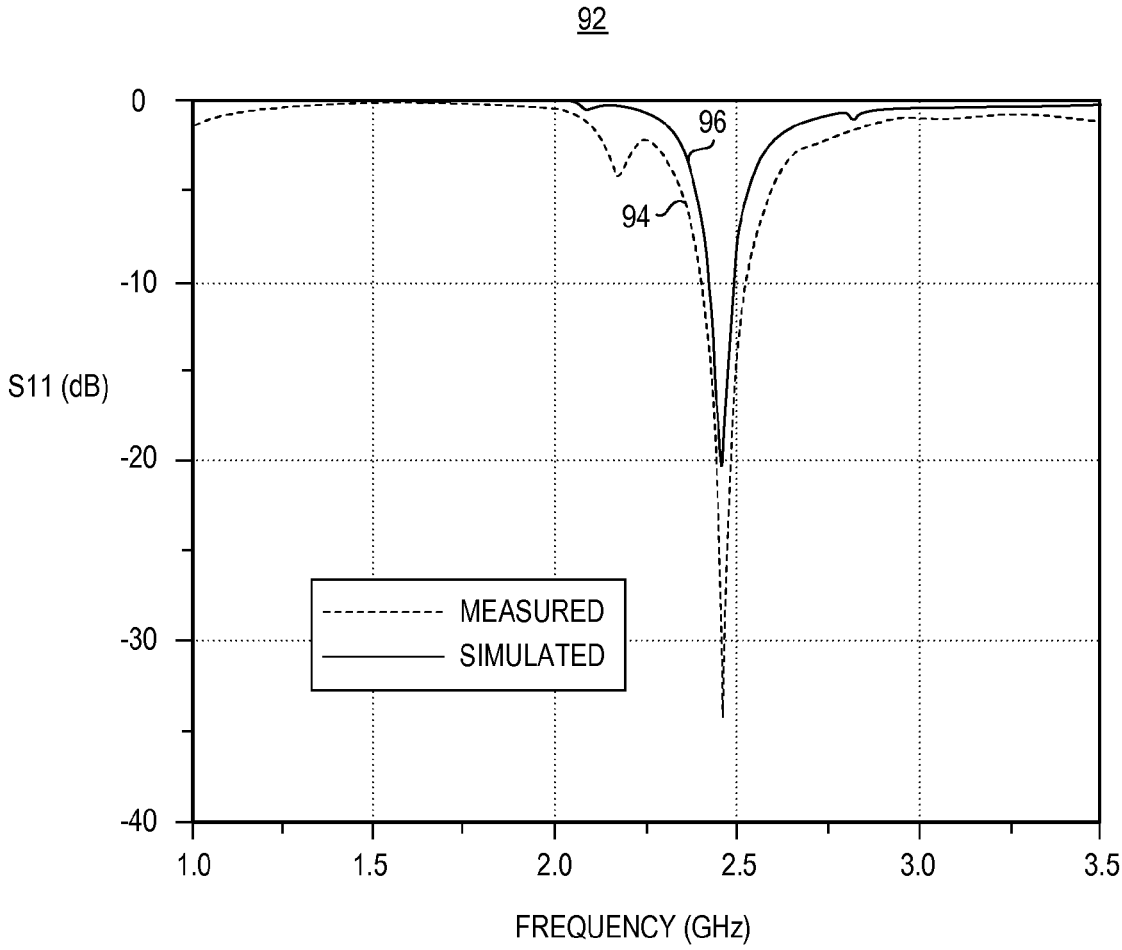
FIG. 3 illustrates a graphical representation showing simulated and measured return losses plotted as a function of frequency of an antenna forming part of a wireless device of an exemplary embodiment of the present invention.

FIG. 3 illustrates a graphical representation 92 illustrating plots 94 and 96 that are representative of simulated and measured return losses, respectively, plotted as a function of frequency. In the exemplary implementation, the antenna is resonant at the 2.4 GHz frequency band, and the plots are indicative thereof.

Figure 4:
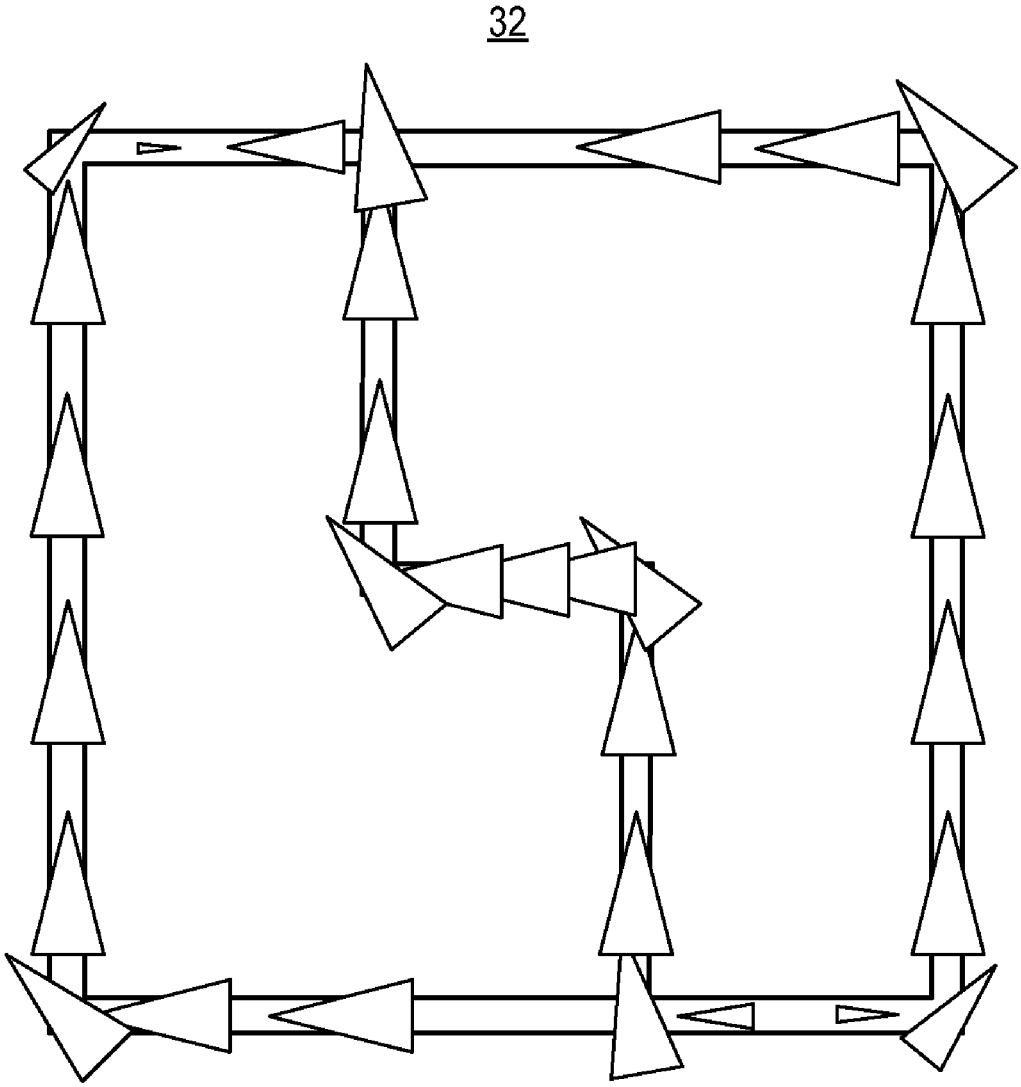
FIG. 4 illustrates a representation of an exemplary, simulated current distribution of an antenna of an embodiment of the present invention.

FIG. 4 again illustrates the antenna 32 of an exemplary embodiment of the present invention. Here, a simulated current distribution exhibited by the antenna at its resonant frequency of 2.47 GHz. The antenna headers represent the current in the antenna. Analysis of the current distribution indicates that the current distribution is in directions parallel to the polarization axes 72 and 74 shown in FIG. 2.

Figure 5:
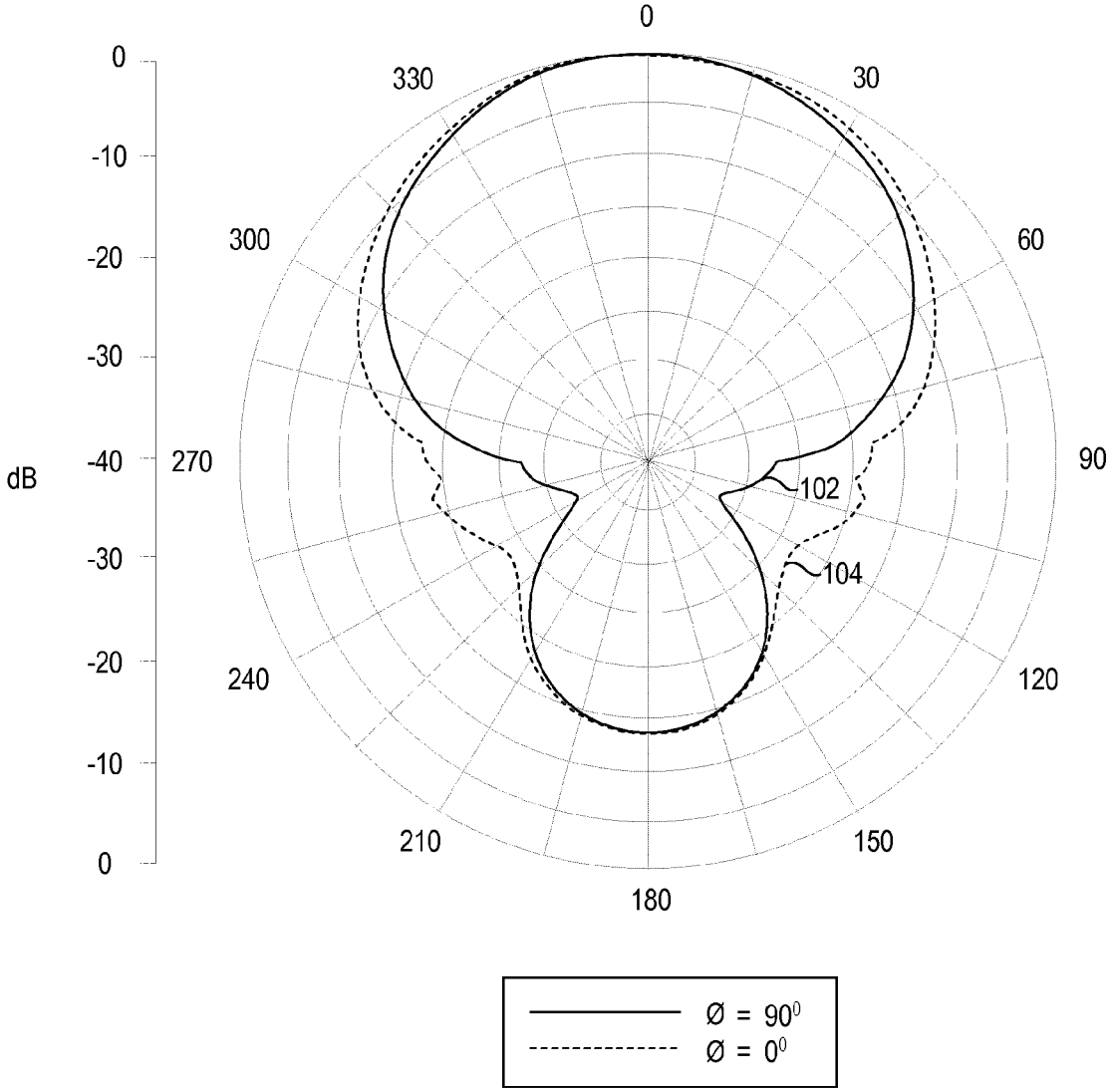
FIG. 5 illustrates a graphical representation of simulated radiation patterns of an antenna of an embodiment of the present invention at 2.47 GHz.
Figure 6:
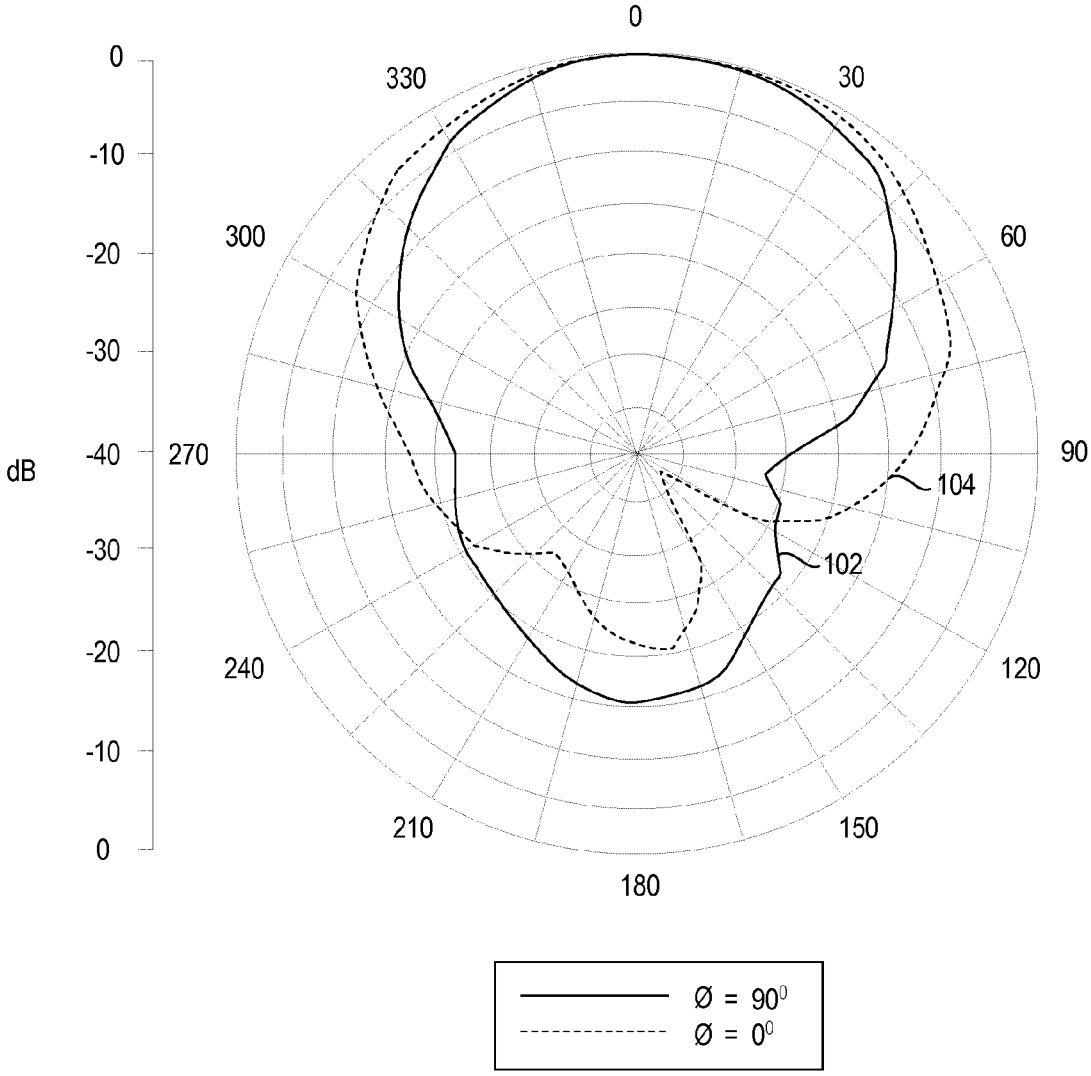
FIG. 6 illustrates a graphical representation, similar to that shown in FIG. 5, but of measured radiation patterns exhibited by an antenna of an embodiment of the present invention at 2.47 GHz.

FIGS. 5 and 6 illustrate, respectively, simulated and measured, two-dimensional, radiation patterns of the antenna 32 of an embodiment of the present invention at its 2.47 GHz resonant frequency. In each representation, both zero and ninety degree-plane representations 102 and 104 are plotted.

Figure 7:
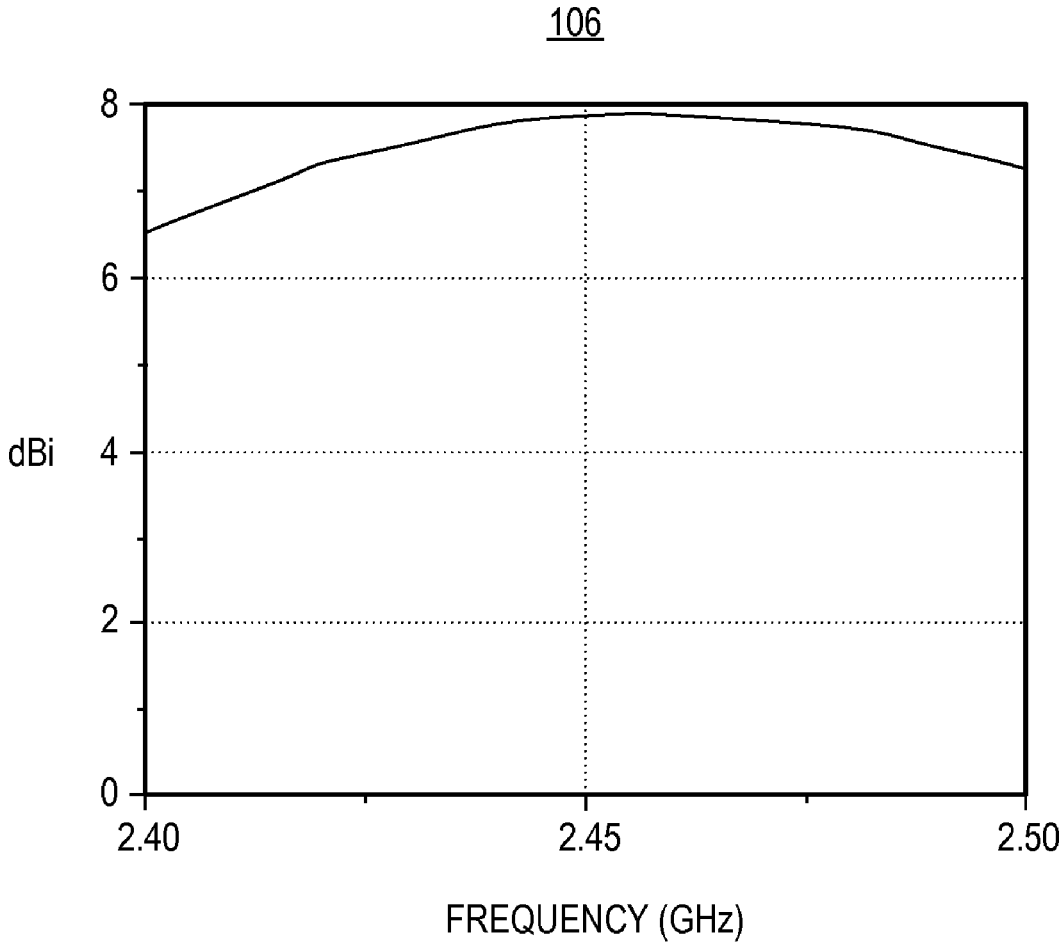
FIG. 7 illustrates a graphical representation showing simulated gain as a function of an antenna of an embodiment of the present invention.

FIG. 7 illustrates a graphical representation 106 illustrating simulated gain, as a function of frequency, exhibited by the antenna 32 of an embodiment of the present invention. The gain is centered at, or close to, the 2.47 GHz resonant frequency.

Figure 8:
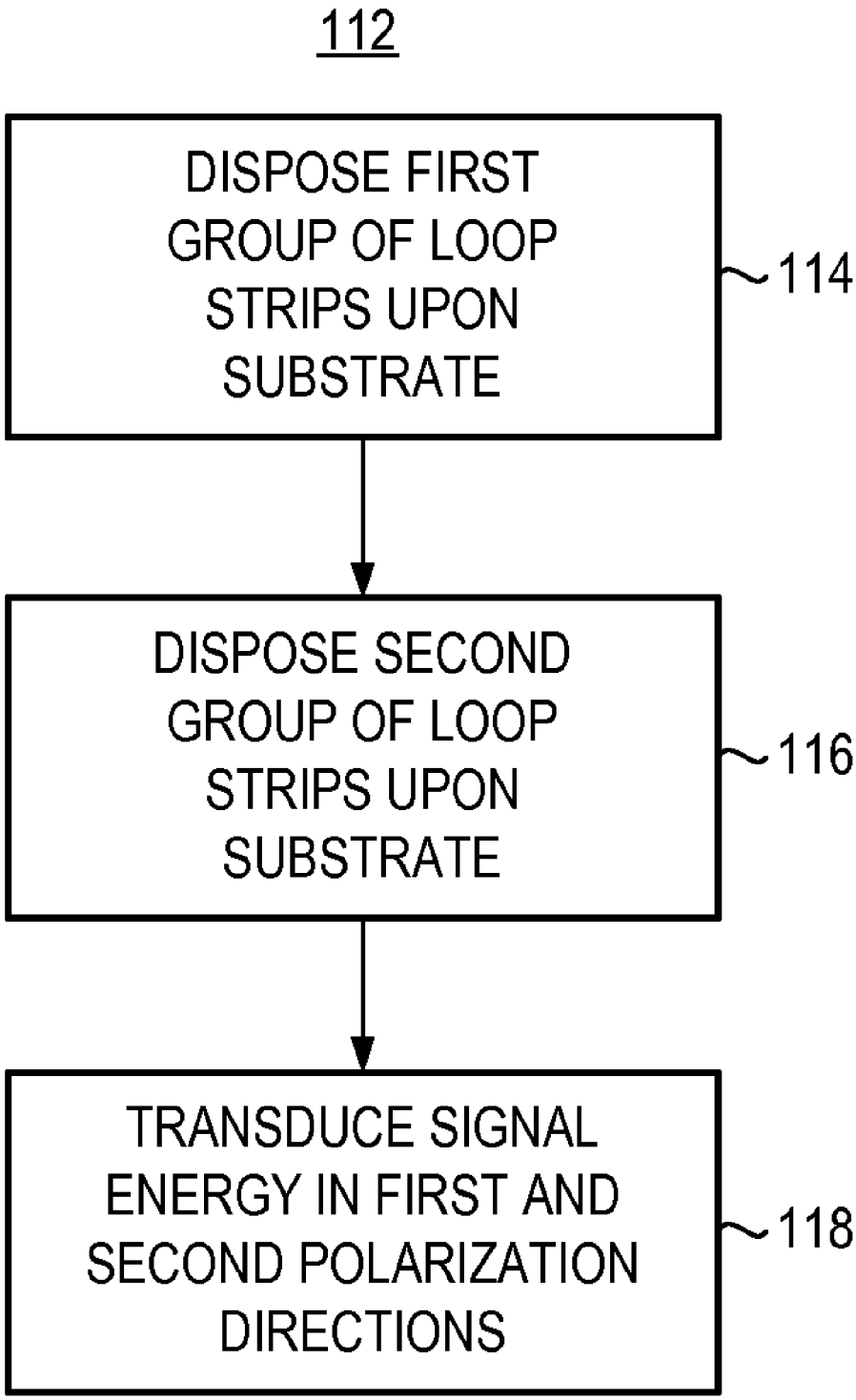
FIG. 8 illustrates a method flow diagram representative of the method of operation of an embodiment of the present invention.

FIG. 8 illustrates a method flow diagram, shown generally at 112, representative of the method of operation of an embodiment of the present invention. The method is for transducing signal energy at a radio device.

First, and as indicated by the block 114, a first group of loop strips are disposed upon a substrate. The loop strips of the first group are configured to form a first loop having at least one strip extending in a first polarization direction and at least one strip extending in a second polarization direction. And, as indicated by the block 116, a second group of loop strips are disposed upon the substrate. The loop strips of the second group are configured to form a second loop having at least one strip extending in the first polarization direction and at least one strip extending in the second polarization direction.

Once formed on the substrate, the loop strips are used to transduce signal energy, polarized in the polarization direction and in the second polarization direction, at the first and second groups, respectively, of the loop strips.

Thereby, a dual-polarized antenna, of compact dimensions is provided. Through the use of loop strips disposed upon a substrate, configured in a manner to permit use of a single feed connection to symmetrically excite the antenna, so-configured, obviates the problems associated with multiple feed connections used by conventional dual-polarized antennas are obviated.

What is claimed is:

1. Antenna apparatus for a radio device, said antenna apparatus comprising:

a substrate;

a first group of loop strips disposed upon said substrate, the loop strips of said first group configured to form a parallelogram, the loop strips of said first group having at least one strip extending in a first polarization direction and at least one strip extending in a second polarization direction; and a second group of loop strips disposed upon said substrate, the loop strips of said second group configured to divide the parallelogram into two substantially equal parts, with the loop strips of said second group extending from a first side of the parallelogram to a second side of the parallelogram, the loop strips of said second group having at least one strip extending in the first polarization direction and at least one strip extending in a second polarization direction, said first group and said second group, each having strips extending in the first and second polarization directions, respectively, exhibiting dual-polarization operation.

2. The antenna apparatus of claim 1 wherein adjacent ones of the strips of said first group intersect at substantially perpendicular angles relative to one another.

3. The antenna apparatus of claim 1 wherein adjacent ones of the strips of said second group intersect at substantially perpendicular angles relative to one another.

4. The antenna apparatus of claim 1 wherein two loop strips of said first group of loop strips and one loop strip of said second group of loop strips extend in the first polarization direction.

5. The antenna apparatus of claim 4 wherein two loop strips of said first group of loop strips and two loop strips of said second group of loop strips extend in the second polarization direction.

6. The antenna apparatus of claim 1 wherein two loop strips of said first group of loop strips and two loop strips of said second group of loop strips extend in the second polarization direction.

7. The antenna apparatus of claim 1 wherein one loop strip of said second group of loop strips extends in the first polarization direction and two loop strips of said second group of loop strips extend in the second polarization direction.

8. The antenna apparatus of claim 7 further comprising a single feed connection formed at the one loop strip said second group of loop strips that extends in the first polarization direction.

9. The antenna apparatus of claim 1 further comprising a single feed connection formed at a loop strip of at least one of said first group and said second group, said single feed connection configured to provide symmetrical excitation of loop strips of said first group and said second group.

10. The antenna apparatus of claim 1 wherein said first group of loop strips and said second group of loop strips are configured to be resonant at a 2.4 GHz frequency band.

11. A dual-polarized antenna apparatus for a radio device housed at a radio housing, said antenna apparatus comprising:

a substrate positionable within the radio housing;

a first plurality of loop strips etched upon said substrate and configured to form a parallelogram , each loop strip of the first plurality extending in one of a first polarization direction and a second polarization direction;

a second plurality of loop strips etched upon said substrate and configured to divide the parallelogram into a first antenna loop and a second antenna loop, each loop strip of the second plurality extending in one of the first polarization direction and the second polarization direction, said first antenna loop and said second antenna loop resonant within a selected frequency band to transduce signal energy polarized in the first polarization direction and in the second polarization direction.

12. The dual-polarized antenna apparatus of claim 11 wherein the selected frequency band at which said first and second antenna loops, respectively, are configured to be resonant comprises an ISM, Industrial Scientific and Medical, frequency band.

13. A method for transducing signal energy at a radio device, said method comprising the operations of:

disposing a first group of loop strips upon a substrate, the loop strips of the first group configured to form a parallelogram, the loop strips of the first loop having at least one strip extending in a first polarization direction and at least one strip extending in a second polarization direction;

disposing a second group of loop strips upon the substrate, the loop strips of the second group configured to divide the parallelogram into two substantially equal parts, with the loop strips of the second group extending from a first side of the parallelogram to a second side of the parallelgram, the loop strips of said second group having at least one strip extending in the first polarization direction and at least one strip extending in the second polarization direction; and transducing signal energy, polarized in the first polarization direction and in the second polarization direction, at the first and second groups, respectively, of the loop strips disposed upon the substrate during said operations of disposing.

14. The method of claim 13 further comprising the operation of connecting to radio device to the first and second groups of the loop strips disposed during said operations of disposing.

15. The method of claim 14 further comprising the operation of symmetrically exciting the first and second groups of the loop strips with signal energy.

16. The method of claim 15 wherein the the loop strips of the second group includes at least one loop strip extending in the first polarization direction and at least one loop strip extending in the second polarization direction.

17. The method of claim 13 wherein the loop strips disposed during said operations of disposing define an in-phase, three-element array in each of the first and second polarization directions.

* * * * *